US005477574A

United States Patent [19]

Skoe

[11] Patent Number: 5,477,574

[45] Date of Patent: Dec. 26, 1995

[54] APPARATUS ENABLING A HANDICAPPED PERSON TO TRANSPORT HIMSELF OR HERSELF TO THE FACILITIES OF A ROOM

[75] Inventor: Raymond C. Skoe, Bloomington, Minn.

[73] Assignee: R. C. Skoe Foundation, Minnetonka, Minn.

[21] Appl. No.: 190,356

[22] Filed: Feb. 1, 1994

[51] Int. Cl.[6] ..... A47K 3/12

[52] U.S. Cl. ..... 4/560.1; 4/254; 135/65

[58] Field of Search ..... 135/65; 4/560.1, 4/561.1, 562.1, 254, 604, 667

[56] References Cited

U.S. PATENT DOCUMENTS

| | | | |
|---|---|---|---|
| 1,076,808 | 10/1913 | Arburg . | |
| 1,668,242 | 5/1928 | Griffith | 4/254 |
| 2,187,283 | 1/1940 | Scheutz . | |
| 3,104,399 | 9/1963 | Dalton . | |
| 3,413,662 | 12/1968 | Stayton | 4/562.1 |
| 3,515,294 | 6/1970 | Southward et al. . | |
| 3,996,631 | 12/1976 | Fields | 4/254 X |
| 4,498,204 | 2/1985 | Warner | 4/254 X |
| 4,606,082 | 8/1986 | Kuhlman . | |
| 4,628,550 | 12/1986 | Walton | 4/560.1 |
| 4,905,327 | 3/1990 | Boublil | 4/562.1 |
| 4,928,330 | 5/1990 | Moore | 4/562.1 |
| 4,951,328 | 8/1990 | Potvin | 4/254 X |
| 4,998,305 | 3/1991 | Davis | 4/560.1 X |
| 5,263,207 | 11/1993 | Gilbert | 4/562.1 |
| 5,279,004 | 1/1994 | Walker | 4/561.1 X |
| 5,365,618 | 11/1994 | Gilbert | 4/560.1 X |

*Primary Examiner*—Wynn E. Wood
*Attorney, Agent, or Firm*—Robert E. Granrud

[57] ABSTRACT

A handicapped person can move with ease about a room from a seat pivotably suspended by a pair of elongated rigid arms from a telescoping post that is mounted in compression between the floor and ceiling of a room. The handicapped person can propel himself or herself through a doorway of a bathroom and into the shower stall or to the sink or to a position over the toilet.

15 Claims, 3 Drawing Sheets

APPARATUS ENABLING A HANDICAPPED PERSON TO TRANSPORT HIMSELF OR HERSELF TO THE FACILITIES OF A ROOM

BACKGROUND OF THE INVENTION

1. Field of the Invention

The invention concerns apparatus enabling a handicapped person to transport himself or herself between various facilities of a room, e.g., to each of the toilet, shower, and sink of a bathroom.

2. Description of the Related Art

A number of devices are known for transporting a handicapped person into and out of a bath. Even though it is well known that handicapped persons like to be as independent as possible, most such devices are designed to be operated by another person. See, for example, U.S. Pats. No. 1,076,808 (Arburg); 2,187,283 (Scheutz); 3,104,399 (Dalton); 3,413,662 (Stayton); 4,606,082 (Kuhiman); and 4,928,330 (Moore). In general, the devices of the cited patents have a seat which is pivotably suspended from a support such as a vertical post, and the seat can be raised to carry a seated person over the edge of a tub and then lowered into the tub.

A number of devices are known that enable a person who is sitting in a wheelchair to be lifted into and out of a vehicle. See, for example, U.S. Pat. No. 3,515,294 (Southward et al.) which shows a wheel chair that can be "raised and lowered in relation to the vehicle and swivelled out from, or into, or back into the vehicle while supporting a person" (col. 1, lines 33–35).

Some devices of the above-cited patents require an expensive, permanent installation, and if it later became necessary to remove the device, it would be expensive to return the installation area to its original condition.

BRIEF SUMMARY OF THE INVENTION

The apparatus of my invention enables a handicapped person to move with ease about a room such as a bathroom and to use its facilities without assistance from another person. A prototype of the novel apparatus that was designed for use in a bathroom should be useable in 80 to 90 percent of American bathrooms without modification, and when modifications are required, they should be inexpensive. The prototype should be less expensive to manufacture than many comparable devices of the prior art. The prototype can be quickly installed at little additional expense and, when removed, it should leave little or no indication that it had been installed, thus eliminating expensive redecoration which would be required upon removal of some devices of the above-cited prior art.

Briefly, the apparatus of my invention includes a) mounting means, b) a first elongated rigid arm, first end of which is pivotably attached to said mounting means to extend substantially in the horizontal direction, c) a second elongated rigid arm, a first end of which is pivotably attached to the second end of the first arm to extend substantially in the horizontal direction, d) a seat pivotably supported from the second end of the second arm, and e) means for adjusting the height of the seat.

Preferably, the mounting means includes a telescoping post by which the apparatus can be removably mounted by putting the post under compression between the floor and ceiling of a room. Suitable as the telescoping post is a basement beam post such as is available in home-building stores. By positioning a broad rigid plate at each end of the telescoping post, the floor and ceiling should be protected from damage.

DESCRIPTION OF THE PREFERRED EMBODIMENTS

Preferably the rigid arms are from 2 to 12 inches (5 to 30 cm) above the floor to be out of the user's way, and the seat is adjustably positioned on a rigid rod that extends vertically from the second end of the second arm. Typically, a user will fix the height of the seat at the level of his or her wheelchair to make it easy to transfer between the wheelchair and the seat. Many handicapped persons have adequate strength to make such a transfer without assistance from another person.

The first and second rigid arms should have a combined length sufficient to allow a seated person to reach various facilities. When a basement beam post is mounted adjacent one wall of a bathroom and each arm extends from 16 to 24 inches (40 to 80 cm) between pivot points, a seated person should be able to reach the sink, position himself or herself over the toilet bowl, and position himself or herself beneath the shower head of a walk-in shower stall of almost every bathroom that is so equipped. The telescoping post and the arms should be sufficiently strong not to bend or quiver under the weight of a seated person when the arms are fully extended. This should be achieved when each of the arms is as strong as a 2-inch (5-cm) steel tubing having a wall thickness of ¼ inch (0.6 cm). Preferably, the pivots are ball bearings or roller bearings to avoid binding under that weight.

Figure 1:
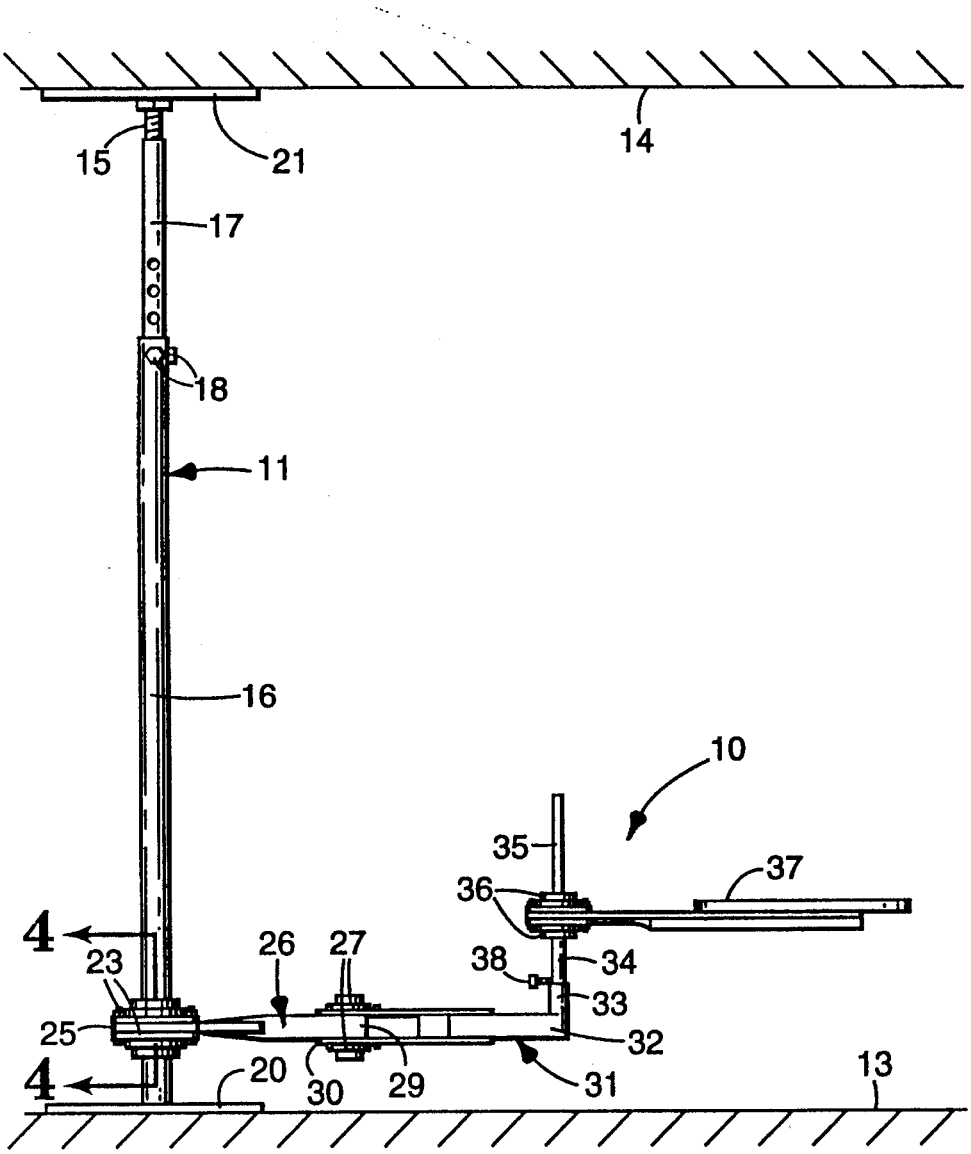
FIG. 1 is an elevation of prototype apparatus of the invention, fully extended.
Figure 2:
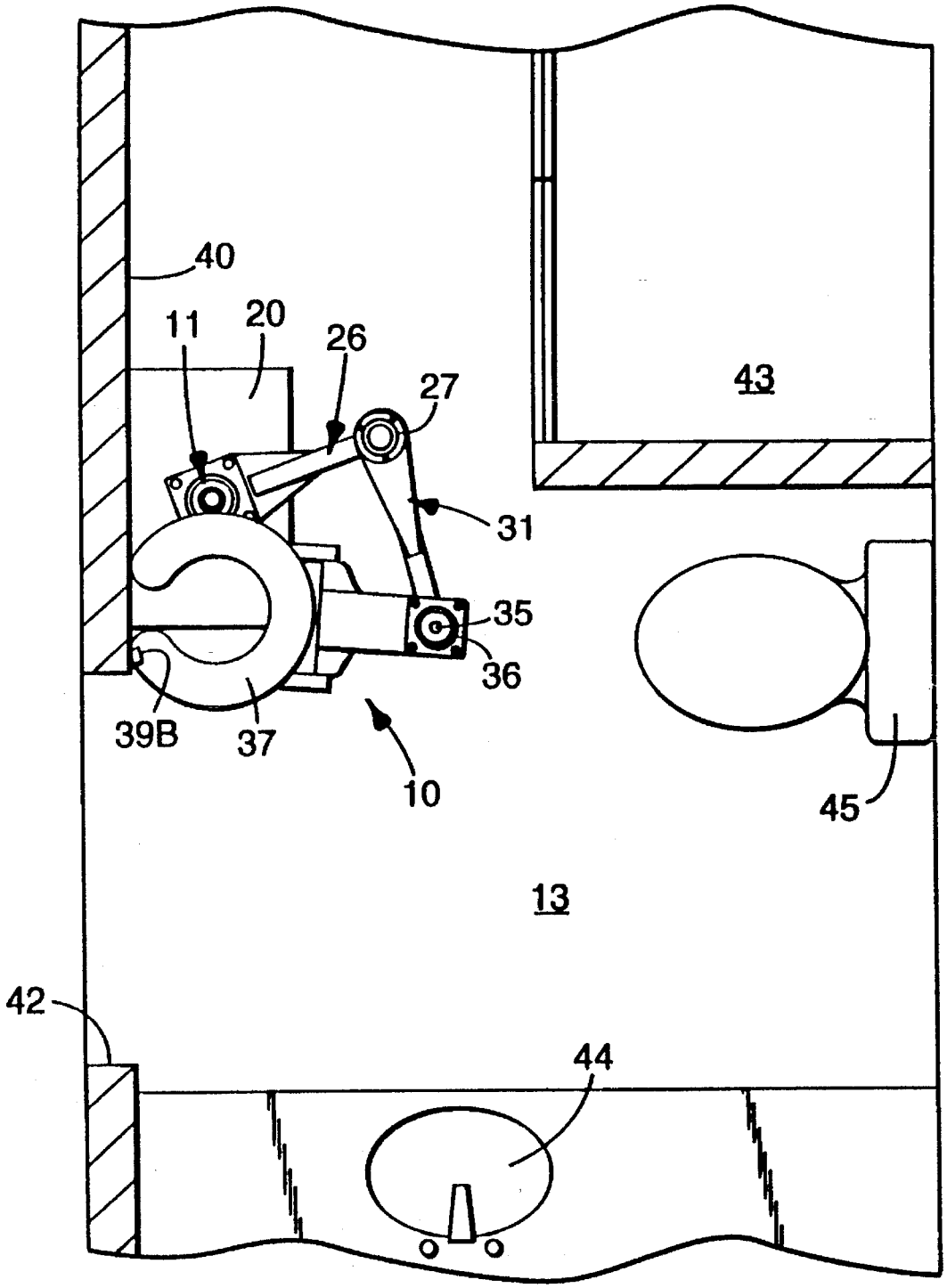
FIG. 2 is a plan view of the prototype apparatus FIG. 1 in its stored position.

The prototype apparatus 10 of FIGS. 1 and 2 includes a telescoping basement beam post 11 that extends in the vertical direction between the floor 13 and ceiling 14 of a bathroom. The post has a cylindrical base tubing 16 receiving a slidable tubing 17 that is locked to the base tubing by a pair of bolts 18 to afford the desired overall height. Threadably received by a collar at the upper end of the slidable tubing 13 is a bolt 15 which can be turned to put the post 11 under compression between the floor and the ceiling. A first broad rigid plate 20 protects the floor, and a second broad rigid plate 21 protects the ceiling.

A first pair of flange-mounted ball bearings 23 are fastened to the post and pivotably support a first end 25 of a first rigid arm 26 that extends in the horizontal direction. A second pair of flange-mounted ball bearings 27 are fastened to the second end 29 of the first rigid arm 26 and pivotably support a first end 30 of a second rigid arm 31 that also extends in the horizontal direction. Integral with the second arm and extending vertically from the second end 32 of the second arm is a large-diameter sleeve 33 that slidably receives a narrower sleeve 34 to which is welded a rigid rod 35. A third pair of flange-mounted ball bearings 36 are fastened to the rod and pivotably support a seat 37 that has the shape of a toilet seat. A bolt 38 extending through aligned openings in the narrower sleeve 34 rests against the top of the large-diameter sleeve 33, thus adjustably fixing the height of the seat. Preferably the rod 35 extends above the seat to provide a convenient handhold for a handicapped person while transfering between the seat and a wheelchair.

Figure 3:
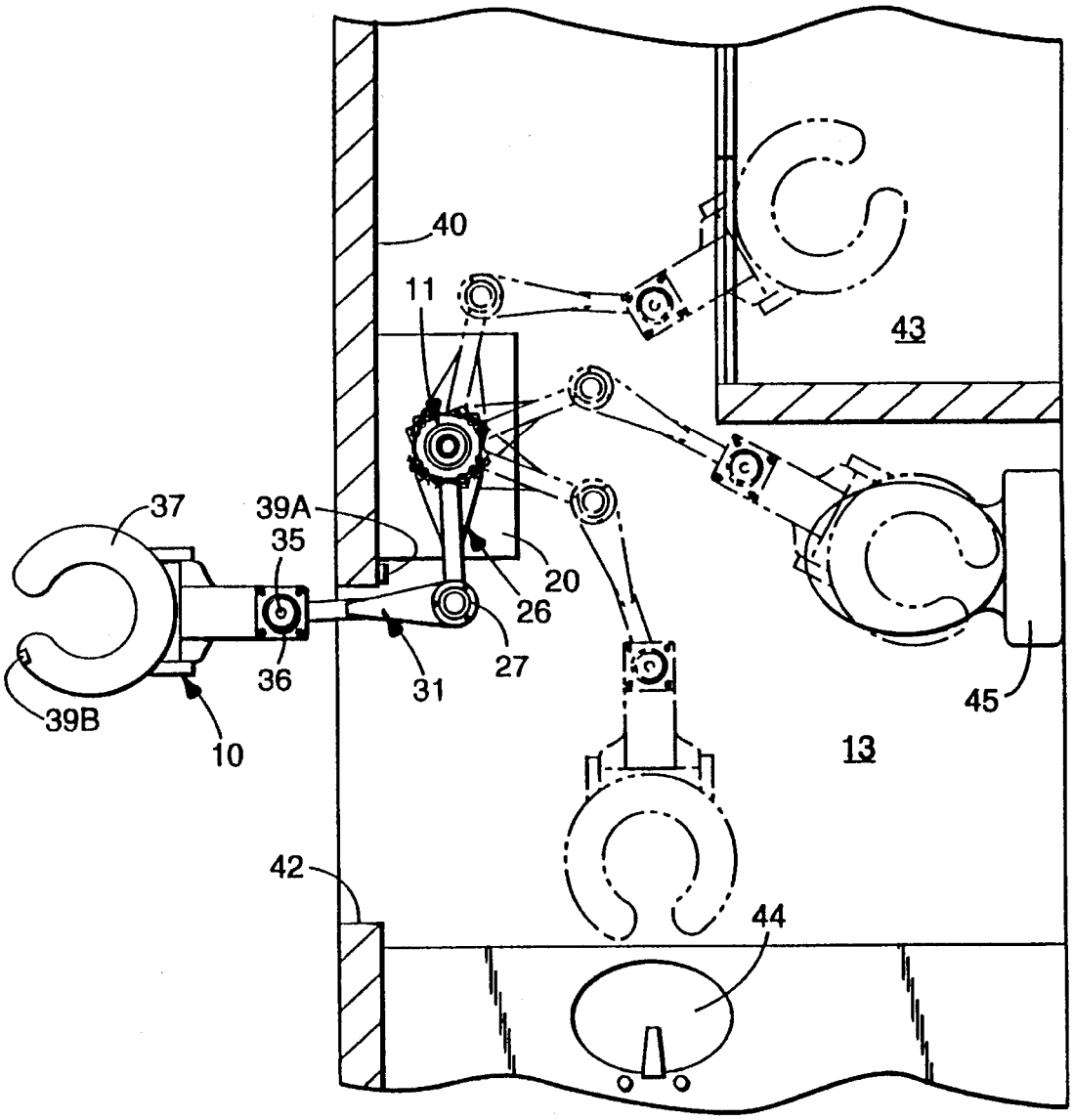
FIG. 3 is a plan view similar to that of FIG. 1 except showing the prototype in various operative positions.

When not in use, the apparatus 10 can be stored against a wall 40, as shown in FIG. 2, to permit the bathroom to be used by an unhandicapped person. It is held in this position by a pair of "Velcro" hook-and-loop fasteners 39A and 39B, one of which has been adhered to the seat 37 and the other, to the wall 40. Referring to FIG. 3, a handicapped person in a wheelchair can pull the seat through a doorway 42 and transfer to the seat. Then by pushing against the wall 40 and other surfaces, he or she can propel himself or herself into a shower stall 43 or to a sink 44 or to a position over a toilet 45.

Figure 4:
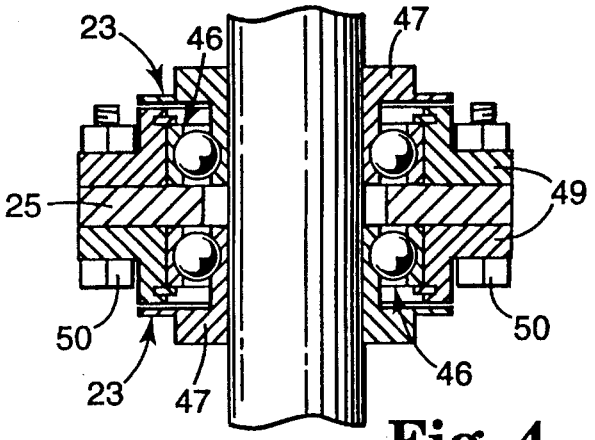
FIG. 4 is an enlarged cross-section through line 4—4 of FIG. 1.

As seen in FIG. 4, each of the first pair of flange-mounted ball bearings 23 contains a ball-bearing race 46, a retainer 47, and a flange 49. Bolts 50 extend through the flanges to clamp the casings to the first rigid arm 26. Each of the second and third pair of flange-mounted ball bearings 27, 36 has the same construction as does the first pair 23.

EXAMPLE

A prototype of the apparatus shown in FIGS. 1–3 has been made of steel (except having a wood seat 37). Its cylindrical base tubing 16 and slidable tubing 17 had outside diameters of 2.5 and 2.25 inches (6.35 and 5.7 cm), respectively, and were ⅛ inch (0.32 cm) in thickness. Each of the first broad rigid plate 20 and second broad rigid plate 21 was rectangular, 12×18 inches (30×45 cm). A larger piece of ¾-inch (1.9-cm) plywood was placed between the second broad rigid plate and the ceiling to afford better protection of the ceiling. Other key features of the apparatus were:

| | |
|---|---|
| length of first rigid arm 26 | 18.5 inches (47 cm) |
| material of first rigid arm 26 | 2.5-inch (6.35 cm) rectangular tubing ¼ inch (0.635 cm) in diameter |
| length of second rigid arm 31 | 20 inches (50 cm) |
| material of second rigid arm 31 | ⅝-inch (1.6-cm) plate |
| large-diameter sleeve 33 | 2-inch (5-cm) diameter tubing ¼ inch (0.635 cm) in diameter |
| narrower sleeve 34 | 1.5-inch (3.8-cm) diameter tubing ¼ inch (0.635 cm) in diameter |

Although the prototype apparatus 10 was constructed for a bathroom, it has other uses. For example, it can be installed in a kitchen for convenient access to each of a sink, range, refrigerator, table, and cupboards; or it can be installed in an office for access to each of a desk, a computer, file cabinets, a copy machine, and a bookcase. Although handicapped persons currently use wheelchairs in kitchens and offices, the novel apparatus should enable such persons to move between such facilities more quickly and easily than they can in a wheelchair. However, because offices often have false ceilings, it may be necessary to employ mounting means that does not use a ceiling, with due regard to the need to make the mounting means strong enough to withstand the weight of a person when the rigid arms of the novel apparatus are fully extended.

What is claimed is:

1. Apparatus enabling a handicapped person to move, without assistance, between facilities of a room which has a floor and a ceiling, said apparatus comprising:

a) a rigid post, b) means for mounting the post to extend substantially vertically between floor and a ceiling, c) first and second elongated rigid arms, each having first and second ends, d) first bearing means pivotably attaching the first end of the first rigid arm to the post so that the first rigid arm extends substantially in the horizontal direction, e) second beating means pivotably attaching the first end of the second rigid arm to the second end of the first rigid arm so that the second rigid arm extends substantially in the horizontal direction, f) a seat, and g) third beating means pivotably attaching the seat to the second end of the second rigid arm.

2. Apparatus as defined in claim 1 and further comprising means for adjusting the height of the seat above the floor.

3. Apparatus as defined in claim 1 wherein the mounting means comprises a telescoping post and means for mounting the post in compression between the floor and the ceiling.

4. Apparatus as defined in claim 3 and further comprising a bolt which is threadably received by the telescoping post and can be rotated to put the post into compression between the floor and ceiling of the room.

5. Apparatus as defined in claim 4 and further comprising a broad rigid plate positioned at each end of the telescoping post to protect the floor and ceiling.

6. Apparatus as defined in claim 1 whereto each of the first, second, and third beating means comprises ball or roller bearings.

7. Apparatus as defined in claim 1 wherein each of the first, second, and third bearing means comprises a pair of flange-mounted ball bearings.

8. Apparatus as defined in claim 1 wherein each of the first and second arms are approximately 16 to 24 inches in length.

9. Apparatus as defined in claim 1 wherein each of the first and second arms is at least equal in strength to a 2-inch steel tubing having a wall thickness of ¼ inch.

10. Apparatus as defined in claim 1 wherein each of the first and second arms is positioned from 2 to 12 inches above the floor.

11. Apparatus as defined in claim 1 and further comprising a rigid rod connected to the second end of the second arm to extend substantially vertically, the third bearing means being fastened to the rod, said rod extending above the seat to provide a handhold.

12. Apparatus as defined in claim 11 and further comprising a large-diameter sleeve which is integral with the, second arm and extends vertically from the second end of the second arm, a narrower sleeve which is slidably received by the large-diameter sleeve, the rigid rod being welded into the narrower sleeve.

13. Apparatus enabling a handicapped person to move, without assistance, between facilities of a room which has a floor and a ceiling, said apparatus comprising:

a) telescoping post, b) a bolt which is threadably received by the telescoping post and can be rotated to put the post into compression between a floor and a ceiling of room while the post extends substantially vertically, c) first and second elongated rigid arms, each having first and second ends, d) a first pair of flange-mounted ball bearings fastened to the post and pivotably attaching the first end of the first rigid arm to the post so that the first rigid arm extends substantially in the horizontal direction, e) a second pair of flange-mounted ball bearings fastened to the second end of the first arm and pivotably attaching the first end of the second rigid arm to the second end of the first rigid arm so that the second rigid arm extends substantially in the horizontal direction, f) a rigid rod connected to the second end of the second arm to extend substantially vertically, g) a seat, h) a third pair of flange-mounted ball bearings fastened to the rod and pivotably attaching the seat to the second end of the second rigid arm, i) each of the first and second arms being aproximately 16 to 24 inches in length, and j) means for adjusting the effective length of the rod to adjust the height of the seat above the floor.

14. Apparatus as defined in claim 13 and further comprising a large-diameter sleeve which is integral with the second arm and extends vertically from the second end of the second arm, a narrower sleeve which is slidably received by the large-diameter sleeve and to which the rigid rod is welded, and means for adjustably fixing the position of the narrower sleeve relative to the large-diameter sleeve to adjust the height of the seat above the floor.

15. Apparatus as defined in claim 14 wherein each of the first and second arms is at least equal in strength to a 2-inch steel tubing having a wall thickness of ¼ inch.

* * * * *